US005664265A

United States Patent [19]

Götter et al.

[11] Patent Number: 5,664,265

[45] Date of Patent: Sep. 9, 1997

[54] METHOD AND APPARATUS FOR SECURING A BUILT-IN-SINK

[75] Inventors: Hans Götter, Sulzfeld; Thomas Ritter, Sinsheim; Horst Zimmerer, Kraichtal; Stefan Hautzinger; Manfred Mück, both of Kürnbach, all of Germany

[73] Assignee: Blanco GmbH & Co. KG, Germany

[21] Appl. No.: 554,478

[22] Filed: Nov. 7, 1995

[30] Foreign Application Priority Data

Nov. 8, 1994 [DE] Germany ..... 44 39 906.5

[51] Int. Cl.[6] ..... E03C 1/33

[52] U.S. Cl. ..... 4/634; 4/631; 4/633

[58] Field of Search ..... 4/634, 631, 633, 4/632

[56] References Cited

U.S. PATENT DOCUMENTS

| | | | |
|---|---|---|---|
| 2,353,777 | 7/1944 | Weissert | 4/631 |
| 2,996,730 | 8/1961 | Hornik | 4/634 |
| 3,034,141 | 5/1962 | Lyon | 4/634 |
| 3,365,732 | 1/1968 | Juergens et al. | 4/634 |
| 4,432,106 | 2/1984 | Smith | 4/634 |

*Primary Examiner*—David J. Walczak

*Attorney, Agent, or Firm*—McAndrews, Held & Malloy, Ltd.

[57] ABSTRACT

A built-in sink made of a plastic composite material is secured in an opening formed in cover plate having a surface for placing a downwardly facing supporting surface of the built-in sink thereon. A securing element having a main body is attached to the built-in sink. A clamping member is held on the main body for displacement in the direction transverse to the cover plate and adapted to be tightened against and supported on the cover plate. A clamping screw is held in a thread of the main body for pressing the clamping member against the cover plate, the thread of the main body being oriented transversely to the cover plate. In order to minimize the manufacturing costs, a slot extending at least approximately parallel to the cover plate is provided in an underside area of the built-in sink located opposite the circumferential surface of the cut-out opening in the cover plate. The main body of the securing element has a projection for insertion in this slot and thereby holding the securing element on the built-in sink.

13 Claims, 4 Drawing Sheets

METHOD AND APPARATUS FOR SECURING A BUILT-IN-SINK

FIELD OF THE INVENTION

The invention relates to a method and apparatus for securing a built-in sink made of a plastic composite material in an opening cut out of a work top or cover plate having a surface for placing a downwardly facing supporting surface of the built-in sink thereon. The securing apparatus comprises a securing element having a main body for attachment to the built-in sink, a clamping element held on the main body for displacement in the direction transverse to the cover plate and adapted to be tightened against and supported on the cover plate, and a clamping screw held in a thread of the main body for pressing the clamping member against the cover plate, the thread of the main body being oriented transversely to the cover plate.

BACKGROUND OF THE INVENTION

When built-in sinks made of a plastic composite material are referred to in this application, these are to be understood not only as sinks cast from a casting resin filled with plastic particles or, for example, formed or pressed from a glass-fiber reinforced plastic, but quite generally as sinks made from a material containing in addition to plastic as matrix material or binder, some fillers or other and/or reinforcement materials and possibly also being in the form of a laminate.

The support formed by the work top or cover plate can be a surface zone of this plate adjoining the opening cut out of it, or also the horizontal area of a step adjoining the opening cut out of the plate and machined from above in the plate, or the lower flank of a groove machined in the circumferential surface of the opening cut out of the plate. The supporting surface of the built-in sink will usually be the horizontal underside of a radially outer rim area of the built-in sink.

Securing elements of the kind described at the outset are known, as is a securing device of the generic kind defined hereinabove. The main body of such a securing element does not necessarily have to consist of one piece. In principle, it could also be comprised of several parts, for example, a nut forming the thread for the clamping screw and a carrier, for example, in the form of a punched and bent part having the shape of a lying U for holding the nut.

The cover plate will usually be the cover plate of a bottom cupboard of a built-in kitchen, however, the cover plate could also be formed by any other kind of plate in which the built-in sink is to be secured.

In a known device of the kind mentioned at the outset for securing a built-in sink cast from a casting resin containing filler particles, several protuberances are formed on the built-in sink below the supporting surface and in the circumferential area of its underside. These are spaced from one another in the circumferential direction of the built-in sink, lie within the opening cut out of the plate, i.e., do not project downwardly over the cover plate, and have outer surfaces located opposite the circumferential surface of the cut-out opening which form a downwardly opening acute angle with the circumferential surface of the cut-out opening. Attached to these outer surfaces of the protuberances are the main bodies of the securing elements, more particularly, by means of screws, for which blind holes, whether it be threadless blind holes into which self-tapping screws are screwed or threaded bores, have been previously drilled in the protuberances. This way of joining the securing elements to the built-in sink has quite a number of disadvantages. In this regard, the making of the blind holes which have to be precisely positioned results in a considerable increase in costs, as does the tightening of at least two fastening screws per securing element. Furthermore, there is the danger that the plastic material of the built-in sink will fracture and break open in the area of the blind holes on the used and visible side of the sink if the tap drill or the self-tapping screw pushes chips or the like ahead of it and presses them together at the bottom of the blind hole when the thread is being made.

An object of the present invention is to provide a more economical way of attaching the securing elements to a built-in sink made of a plastic composite material.

The inventive solution to this problem originates from the consideration that built-in sinks made of a plastic composite material require finishing on a milling machine, above all, in the region of the sink rim. At that time, however, while the sink is set up for this purpose, horizontal slots, i.e. extending parallel to the supporting surface of the built-in sink, or even a continuous circumferential slot can be milled in an extremely economical way with the milling machine at the places in the built-in sink where the securing elements are to be attached, and so only the main body of the securing elements has to be provided with a projection which is fittingly insertable, preferably with a press fit, into such a slot and thus holds the pertinent securing element on the built-in sink. Accordingly, an inventive device of the kind described at the outset is characterized by a slot extending at least approximately parallel to the cover plate being provided in an underside area of the built-in sink located opposite the circumferential surface of the opening cut out of the cover plate, and the main body of the securing element having a projection for insertion in this slot and thereby holding the securing element on the built-in sink.

The inventive securing device first results in the drilling operation which has to be carried out with an additional device and also the operation of screwing-in the fastening screws being dispensed with, which allows the manufacturing costs to be reduced. Furthermore, during the milling of the slot or slots and the attachment of the securing elements to the sink, there is no danger of the visible side of the built-in sink being damaged. Finally, there is no problem with positioning the slot or slots precisely, as the milling of the slots can be carried out while the sink is set up in the milling machine for the operation of finishing the sink rim, as explained hereinabove.

Depending on the design of the main body of the securing elements (the projection to be inserted into the slot could, for example, be connected to the main body via a web or the like extending upwardly from the actual main body), the main body of the securing elements does not necessarily have to be arranged in the space between the circumferential surface of the opening cut out of the cover plate and the underside of the built-in sink. Embodiments of the securing element in which the main body protrudes into this space and has a supporting area adapted to lie against the circumferential surface of the cut-out opening are, however, recommended. As that area of the clamping member which during the tightening of the clamping screw is supported on the cover plate lies on the side of the securing element facing away from the aforementioned projection and the slot, respectively, viewed in the vertical direction, the projection tends to slide out of the slot during the tightening of the clamping screw and the pressing of the clamping member against the cover plate. However, this can be avoided in such embodiments by the main body being supported by the circumferential surface of the cut-out opening, more particularly, in a position in which its projection at least still protrudes into the slot. Such support is particularly effective when the supporting area of the main body is located approximately opposite its projection, viewed in the horizontal direction.

The projection could have the shape of a tongue or several tongues arranged in spaced relation to one another in the circumferential direction of the opening cut out of the plate. However, greater stability is obtained when the projection is in the form of quite a long (measured in the longitudinal direction of the slot) web, and embodiments are preferred in which the length of the web is at least approximately equal to the width (again measured in the longitudinal direction of the slot) of the clamping member so that there is located opposite each point of the clamping element supported on the cover plate a point on the web through which the reaction forces can be introduced into the sink body.

As mentioned hereinabove, the main body could, for example, be in the form of a punched metallic bent part. However, since such securing elements are always manufactured in large numbers, favorable manufacturing costs are achievable by the main body including the projection being produced in an injection molding process and, in particular, formed by a plastic injection molded part. This measure also makes it possible to provide in an extremely economical way means for effectively preventing the projection on the main body of the securing element from being pulled out of the sink slot. For this purpose, it is proposed that the projection be provided with at least one elevation for counteracting the pulling of the projection out of the slot, and, in particular, that there be formed on the projection in the form of a web at least one lamina forming one such elevation which extends away from the web, more particularly, obliquely in the direction of withdrawal of the web from the sink slot so that the lamina becomes jammed between web and adjacent slot wall when an attempt is made to pull the web out of the sink slot.

As is customary with sink securing elements, in preferred embodiments of the securing element, its clamping screw extends through an opening in the clamping member and lies with its screw head from below against the clamping member. In order that the clamping member cannot turn along with the clamping screw when it is being turned, before the clamping member is pressed against the cover plate, it is recommended that the main body be designed so as to form for the clamping member at least one slide or guide surface extending in the longitudinal direction of the screw and acting as means for preventing turning.

As will be evident from the following, the invention makes it possible, without any additional cost, for the sink to be secured either with a clamping member which engages under the cover plate in the known way or with a clamping member which is designed in the known way as a spreading part for support on the circumferential surface of the cutout opening. Accordingly, preferred embodiments of the invention are characterized by the main body being selectively combinable with a clamping member designed as an under-engaging part for engaging under the cover plate or as a spreading part adapted to be supported on the circumferential surface of the cut-out opening. This results in a further reduction of costs if there is a market for both types of fastening.

If each of the slots is substantially longer than the projection of the associated securing element or if the built-in sink is provided with a continuous circumferential slot, the invention offers a further important advantage. In particular with plastic sinks, it is sometimes the case, depending on the manufacturing process, that not all of the areas of the supporting surface of the built-in sink with which it rests on the cover plate lie in a common plane. However, with longer slots or a continuous slot, the invention makes it possible, by appropriate placing of the securing elements, for the sink rim to be pulled downwards with the aid of the securing elements at those points where it would otherwise lie somewhat higher. This is highly advantageous, particularly for so-called flush mounting of the sink (with flush mounting, the highest areas of the sink lie at the level of the upper side of the cover plate).

SUMMARY OF THE INVENTION

The above and other objects are achieved by an apparatus for securing a built-in sink in an opening formed in a cover plate having a surface for placing a downwardly facing supporting surface of the built-in sink thereon. The apparatus comprises:

(a) a securing element having a main body for attachment to the built-in sink, (b) a clamping member held on the main body for displacement in the direction transverse to the cover plate and adapted to be tightened against and supported on the cover plate, and (c) a clamping screw held in a thread of the main body for pressing the clamping member against the cover plate, the thread of the main body being oriented transversely to the cover plate, wherein at least one slot extending at least approximately parallel to the cover plate is formed in an underside area of the built-in sink located opposite the circumferential surface of the cut-out opening in the cover plate, and wherein the main body of the securing element is provided with a projection for insertion in the slot, whereby the securing element is held on the built-in sink.

In the preferred apparatus, the built-in sink is made of a plastic composite material. The main body preferably protrudes into a space formed between the circumferential surface of the cut-out opening in the cover plate and the underside of the built-in sink and wherein the main body has a supporting area adapted to lie against the circumferential surface of the cut-out opening. The supporting area preferably lies approximately opposite the projection.

In the preferred apparatus, the projection has the shape of a web. The length of the web as measured in the circumferential direction of the cut-out opening in the cover plate is preferably greater than or equal to the width of the clamping member.

In the preferred apparatus, the main body including the projection is formed by plastic injection molding. The maximum thickness of the projection measured in the longitudinal direction of the clamping screw is preferably greater than the width of the slot measured in the same direction. The projection is preferably provided with at least one elevation to counteract the pulling of the projection out of the slot. The web is preferably provided with at least one lamina forming the elevation.

In the preferred apparatus, the main body forms at least one slide surface for the clamping member, the slide surface extending in the longitudinal direction of the screw and preventing turning of the clamping member. The main body is preferably combinable with a clamping member which is an under-engaging part for engaging under the cover plate. Alternatively, the main body is combinable with a clamping member which is a spreading part adapted to be supported on the circumferential surface of the cut-out opening.

In the preferred apparatus, the main body has a block-shaped portion in which the thread is located and on which the projection is formed. Reinforcement fins are preferably provided at the transitions between the web and the two side surfaces of the block-shaped portion.

In the preferred apparatus, a plurality of protuberances is formed on the built-in sink below its supporting surface in the circumferential area of its underside, the protuberances in spaced relation to one another in the circumferential direction of the sink, each of the protuberances having a slot formed in its outwardly pointing surface. The slot is preferably longer than the projection. The slot preferably extends continuously around the built-in sink.

The above and other objects are also achieved by a method of securing a built-in sink in an opening formed in a cover plate having a surface for placing a downwardly facing supporting surface of the built-in sink thereon. The method comprises:

(a) providing a securing element having a main body for attachment to the built-in sink, (b) providing a clamping member held on the main body for displacement in the direction transverse to the cover plate and adapted to be tightened against and supported on the cover plate, and (c) providing a clamping screw held in a thread of the main body for pressing the clamping member against the cover plate, the thread of the main body being oriented transversely to the cover plate, (d) forming at least one slot in an underside area of the built-in sink located opposite the circumferential surface of the cut-out opening in the cover plate, and wherein the main body of the securing element is provided with a projection for insertion in the slot, the at least one slot extending at least approximately parallel to the cover plate, In operation, displacing the clamping screw in the main body thread secures the securing element in the slot of the built-in sink.

Further features, advantages and details of the invention are apparent from the appended claims and/or the attached drawings and from the following detailed description of two particularly advantageous embodiments of the securing device according to the invention.

DETAILED DESCRIPTION OF THE PREFERRED EMBODIMENTS

Figure 1:
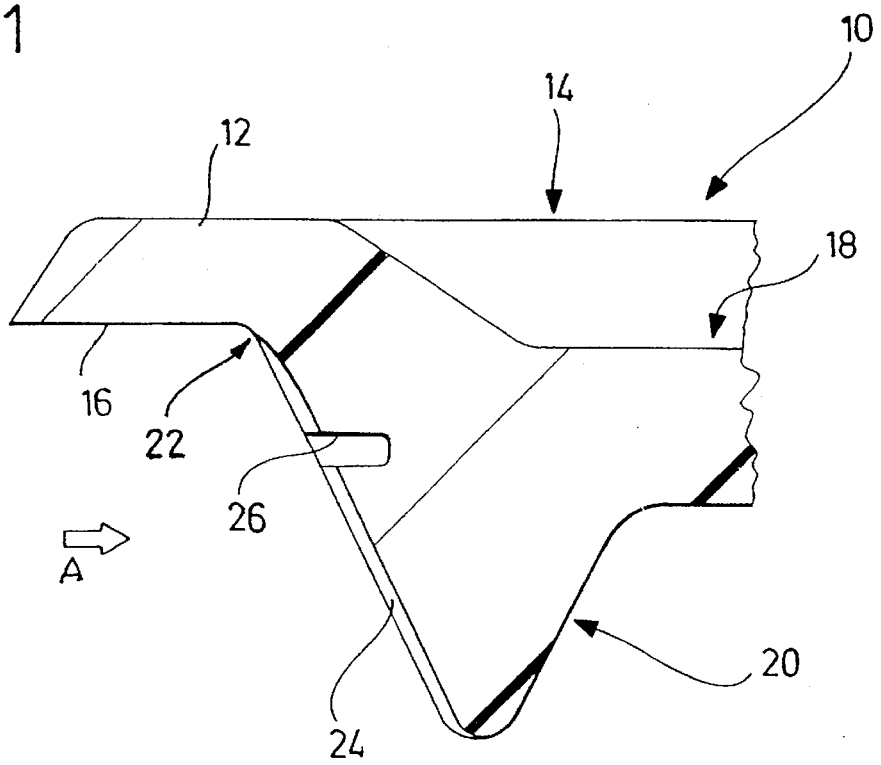
FIG. 1 is a sectional view through the rim area of a plastic built-in sink which is part of the inventive securing device, more particularly, a section taken on line 1—1 in FIG. 2.
Figure 2:
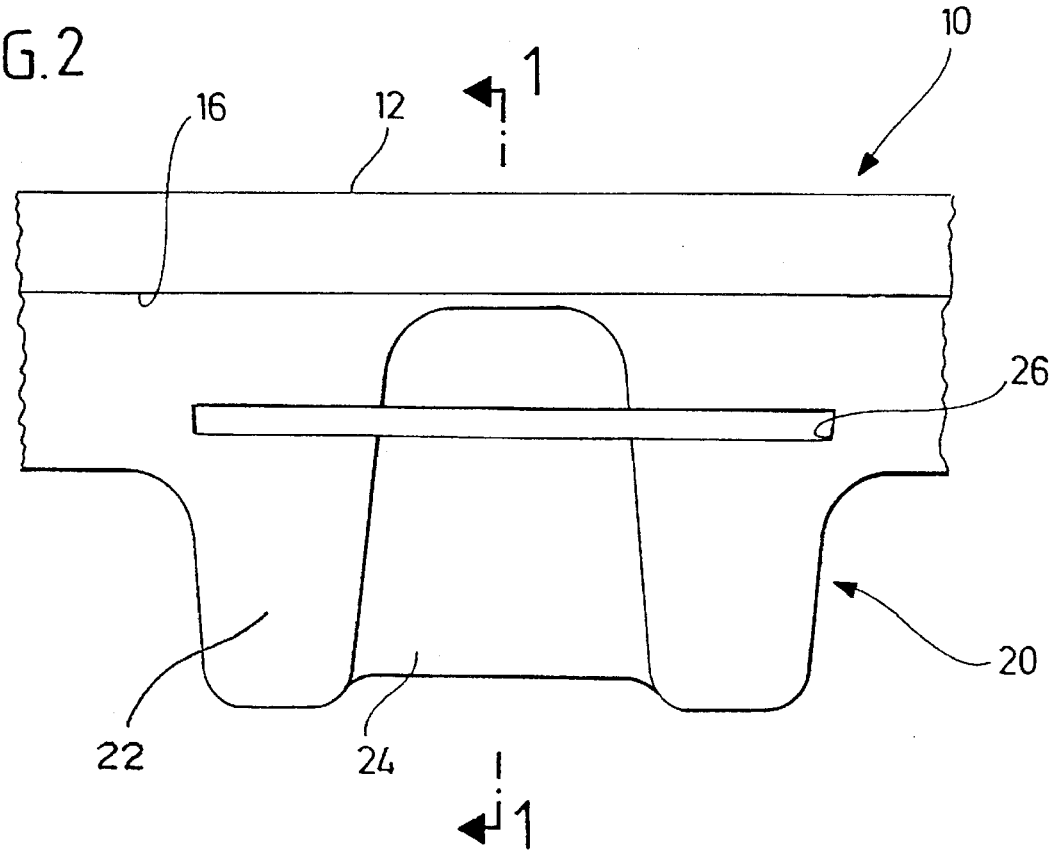
FIG. 2 is a side view of part of this built-in sink, more particularly, viewed in the direction of arrow A in FIG. 1.

Turning first to FIGS. 1 and 2, built-in sink 10 has a rim flange 12 extending around the entire sink, with a hollow portion 14 adjoining the rim flange 12 inwardly. The underside of the rim flange 12 forms an at least essentially planar, ring-shaped supporting surface 16 extending horizontally. As will be described hereinbelow, the built-in sink can be placed with this supporting surface on a corresponding support of a cover plate or work top. On the side illustrated in FIG. 1, in the area of the hollow portion 14, the built-in sink 10 forms a drain surface 18 which can have an adjoining basin, not illustrated, on the right according to FIG. 1.

Formed on the underside of the built-in sink 10 and distributed over its circumference are several protuberances 20, only one of which is illustrated in FIGS. 1 and 2. Each of these protuberances forms an outer surface 22 extending obliquely from above and outside downwardly and inwardly and having two areas spaced from one another in the transverse direction, with a flat recess 24 located between them.

Insofar as the built-in sink 10 has been described hereinabove, it corresponds fully to the prior art.

In accordance with the invention, a horizontal slot 26 is milled into the outer surface 22 of each of the protuberances 20. Further details of its vertical position, length and width will be given hereinbelow.

FIG. 1 is also to be understood as an illustration of a variant in which the slot 26 extends continuously around the entire built-in sink 10.

The first embodiment of the Securing element forming part of the inventive securing device will now be explained with reference to FIGS. 3 and 5. The securing element designated in its entirety 28 has a main body 30 in the form of a plastic injection-molded part with an approximately block-shaped portion 32 having formed on either side thereof a fin 34 which extends approximately parallel to the outer surface 22 of the associated protuberance 20 of the built-in sink when the sink is in the built-in state. At the top, a web 36 is formed on the block-shaped portion 32 and on the two fins 34. In the built-in state, the web extends horizontally and has two obliquely extending, elastically deformable laminae 38 formed on its upper side. As is apparent from FIG. 5, the web 36 and the laminae 38 are of such dimensions that the web can be pushed with a press fit into the slot 26 to such an extent that the block-shaped portion 32 and the fins 34 lie with their oblique surfaces on the right according to FIG. 5 against the outer surface 22 of the associated protuberance 20, with the laminae thereby undergoing slight deformation.

Figure 5:
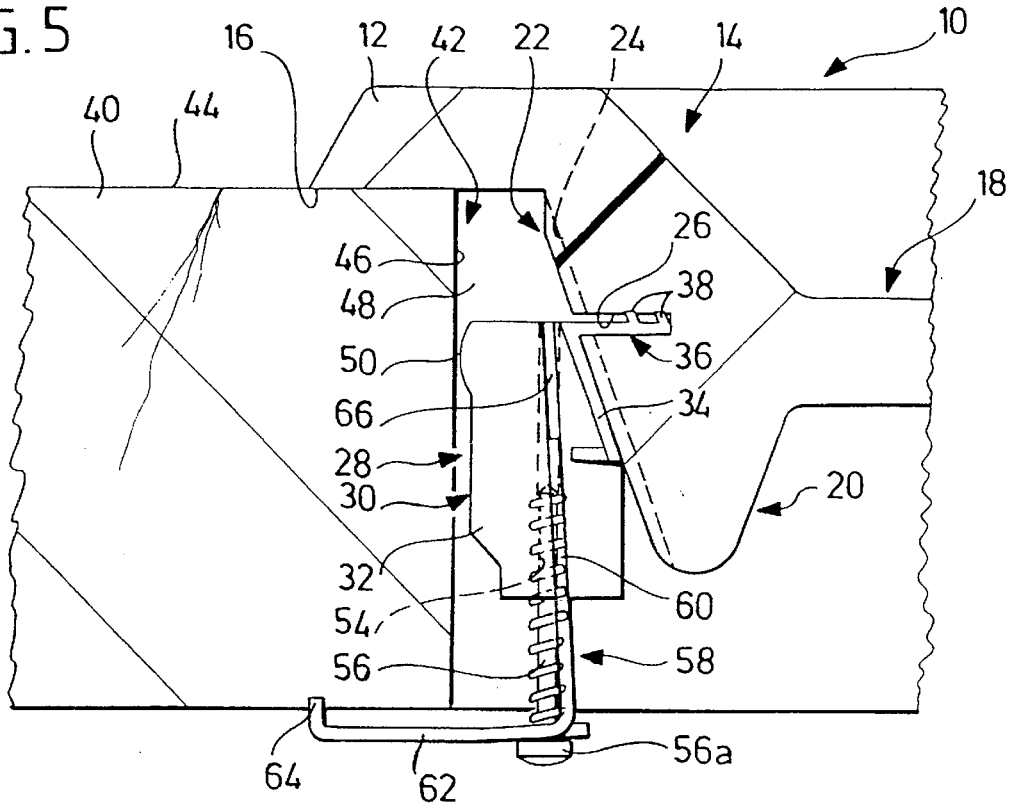
FIG. 5 is a partial vertical sectional view through a cover plate with a sink in the built-in state, more particularly, for the embodiment according to FIGS. 1 to 3.

The cover plate 40 illustrated in FIG. 5 has a cut-out opening 42 which forms a window-like opening in the cover plate and is of such dimensions that it can receive the areas of the built-in sink 10 located underneath the supporting surface 16. With the type of installation illustrated in FIG. 5, the supporting surface 16 rests on the upper surface 44 of the cover plate 40, and the size of the cut-out opening 42 is such as to produce between the outer surfaces 22 of the protuberances 20 and a circumferential surface 46 of the cut-out opening 42 an approximately wedge-shaped space 48 into which the main body 30 of the securing element 28 protrudes. In accordance with the invention, the cut-out opening 42 is of such dimensions that in the built-in state, a supporting area 50 of the main body 30 located approximately opposite the web 36 lies against the circumferential surface 46 of the cut-out opening when the web 36 is at least almost completely inserted into the slot 26. According to a further feature of the invention, the length of the slot 26, as measured in the circumferential direction of the built-in sink 10 or the cut-out opening 42, is to be greater than the length of the web 36. The slot 26 should also be located at such a level below the supporting surface 16 that the geometrical relations explained hereinabove prevail in the built-in state.

The main body 30 is provided with a vertical threaded bore 54 into which a clamping screw 56 is screwed from below. This serves to adjust a clamping member 58 which in the embodiment of the securing element illustrated in FIGS. 3 and 5 is a punched and bent part made from sheet steel and approximately L-shaped when viewed from the side. It has two guide webs 60 and a foot 62 which carries two upwardly bent claws 64. Also provided in the foot 62 is a hole, not further designated, through which the clamping screw 56 extends so its head 56*a* lies from below against the clamping member 58. In accordance with the invention, the main body 30 has on either side thereof a guide slot 66 in which the guide webs 60 of the clamping member 58 are displaceably guided so that the clamping member cannot turn relative to the main body 30 when the clamping screw 56 is turned.

Finally, in accordance with a further feature of the invention, approximately triangular-shaped reinforcement fins 70 are formed by injection molding on the main body 30 between the two side surfaces of the block-shaped portion 32 of the main body 30 and the fins 34 in order to prevent undesired deformations of the main body 30 while the clamping screw 56 is being tightened.

As is apparent from FIG. 5, the foot 62 engages under the cover plate 40 in the built-in state and when the clamping screw 56 is tightened, the claws 64 dig into the material of the cover plate. At the same time, the supporting surface 16 of the built-in sink 10 is drawn against the upper surface 44 of the cover plate 40 and the built-in sink is thus secured to the cover plate. Although, as is apparent from FIG. 5, the tightening of the foot 62 against the underside of the cover plate 40 leads to reaction forces which attempt to pull the web 36 out of the slot 26, this is not possible because the supporting area 50 is pressed against the circumferential surface 46 of the cut-out opening at least in the course of the tightening of the clamping screw 56. In addition, the oblique position of the laminae 38 leads to these being insertable into the slot 26, but to their being jammed in the slot when an attempt is made to pull the web 36 out of the slot 26.

As is readily apparent from FIG. 5, the invention is not only applicable to built-in sinks having the protuberances 20. On the contrary, the protuberances can be dispensed with if the depth of the hollow portion 14 is large enough to enable the slots 26 to be made without weakening the sink wall to an inadmissible extent. In such a case, several slots 26 could be replaced by a single slot extending around the entire built-in sink although even with such a deeper hollow portion, several slots arranged in spaced relation to one another are preferred in order to avoid formation of a potential breaking point in the built-in sink by a continuous circumferential slot.

Furthermore, the web 36 could also be glued into the slot 26 and the laminae 38 thereby dispensed with. In this connection, it should be noted that fixing of the web 36 in the slot 26 is only necessary until the built-in sink together with the securing elements attached to it has been placed in the cut-out opening 42 for the webs 36 can then no longer fall out of the slots 26 even if the webs neither have laminae 38 nor are glued into the slots (of course, the built-in sink is placed in the cut-out opening 42 so long as the feet 62 of the clamping members 58 do not yet protrude outwardly, either because the clamping screws 56 together with the clamping members 58 are only mounted later or because the clamping screw 56 has not yet been screwed into the threaded bore 54 to the extent that the guide webs 60 already engage the guide slots 66, and so the clamping member 58 can still be turned around the clamping screw 56).

Figure 3:
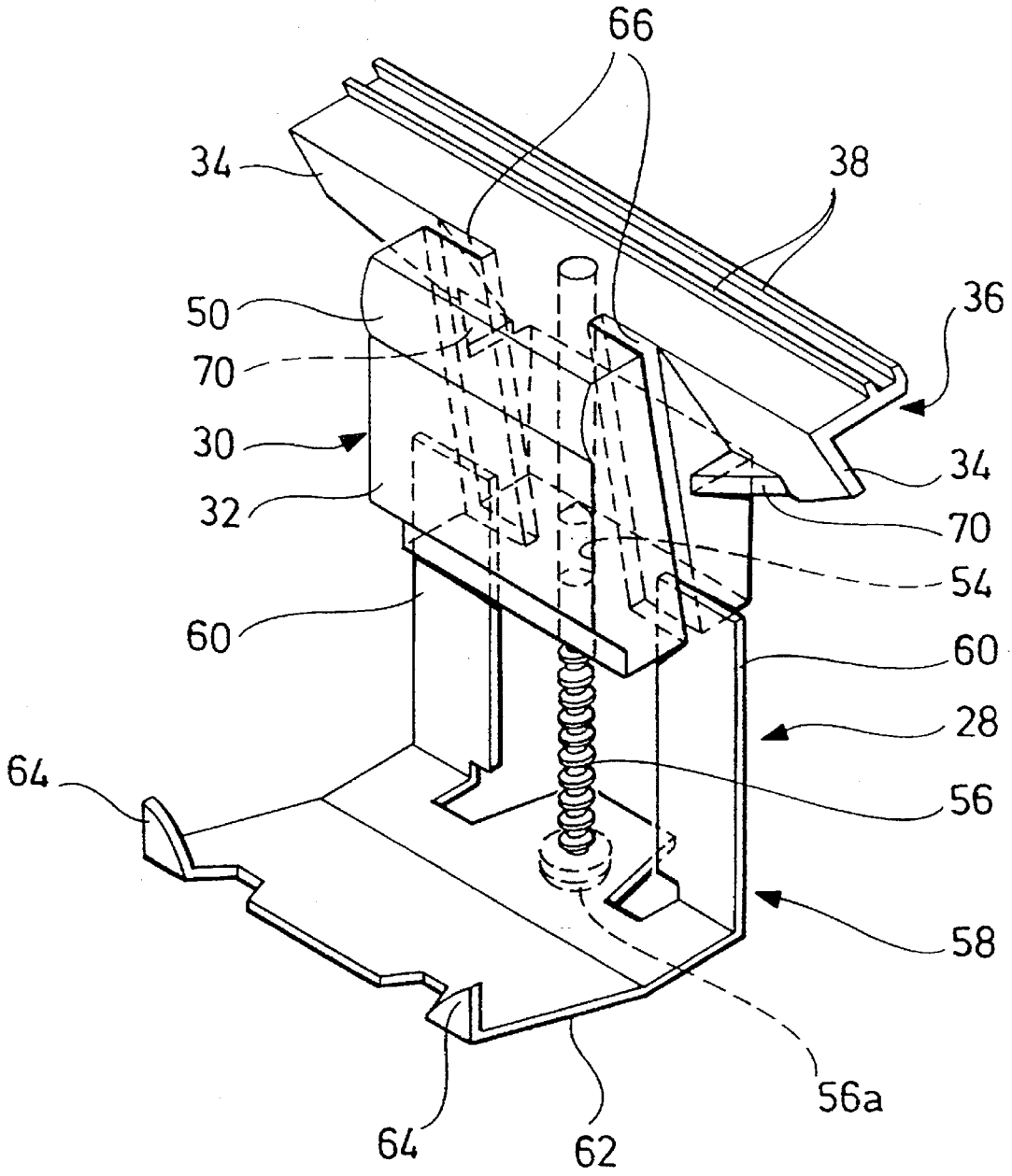
FIG. 3 is a perspective view of a first preferred embodiment of a securing element which is part of the inventive securing device.

In the embodiment of the securing element illustrated in FIGS. 3 and 5, the securing element is provided with a clamping member 58 which forms an under-engaging part, i.e., a part for engaging under the cover plate 40. In this respect, the second embodiment of the securing element illustrated in FIGS. 4 and 6 differs from that according to FIGS. 3 and 5.

Figure 4:
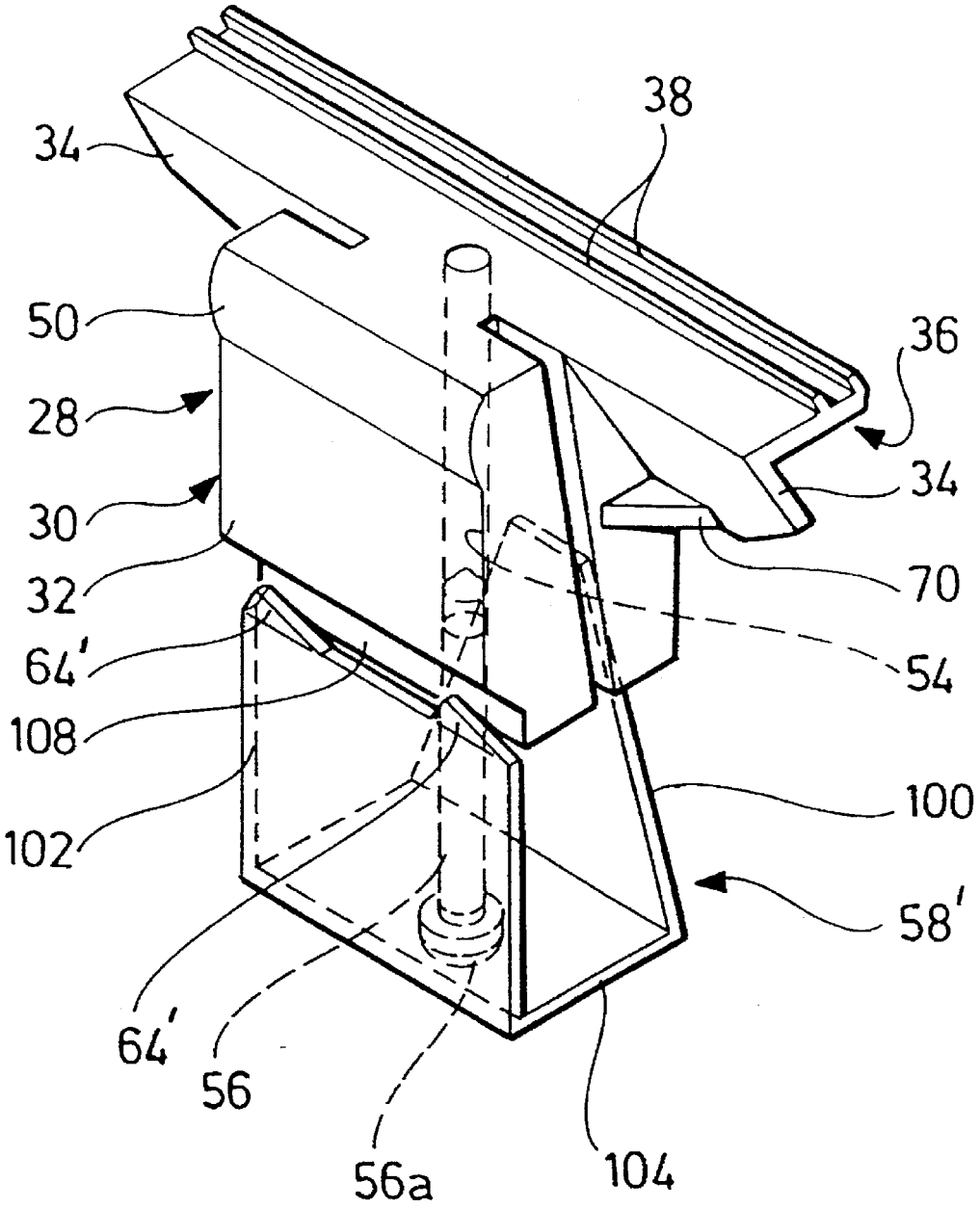
FIG. 4 is a perspective view of a second embodiment of the securing element.
Figure 6:
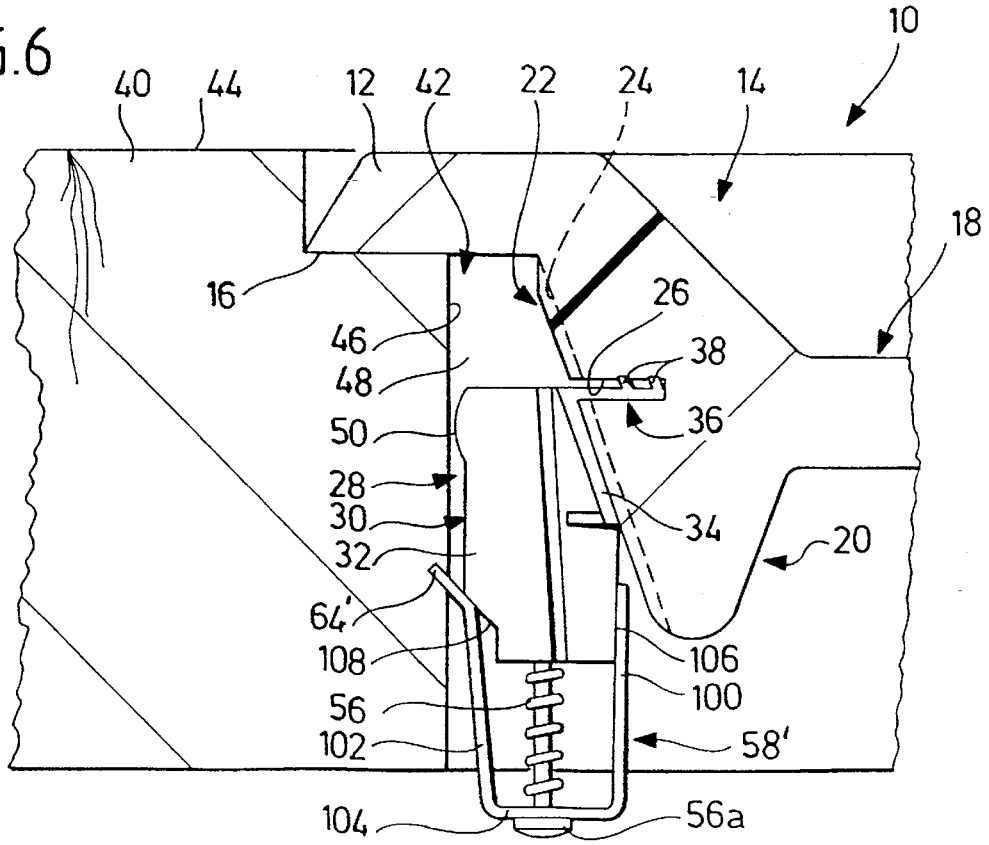
FIG. 6 is a sectional view corresponding to FIG. 5 for the embodiment according to FIGS. 1, 2 and 4.

As is apparent from FIGS. 4 and 6, the second embodiment of the securing element differs from the first embodiment thereof only in the design of the clamping member 58'. In the second embodiment, a clamping member 58' is designed as a spreading part which in the tightened state is supported on the circumferential surface 46 of the cut-out opening 42 of the plate.

In a side view, the clamping member 58' is approximately U-shaped, and, again, it is designed as a punched and bent part made from sheet steel. It has a guide leg 100, a spreading leg 102 and a cross-bar 104 connecting the two legs, with an opening, not further designated, for passage of the clamping screw 56 therethrough. The guide leg 100 preventing unintentional turning of the clamping member 58' lies against an inner surface 106 of the main body 30 having on its outside an oblique surface 108 along which the spreading leg 102 slides when the clamping screw 56 is tightened (see FIG. 6). During this, two claws 64' of the spreading leg 102 dig into the circumferential surface 46 of the cut-out opening 42 in the plate because the claws 64' are moved upwardly and outwardly, i.e., upwardly and to the left according to FIG. 6 while the spreading leg 102 slides along the oblique surface 108 of the main body 30.

In the second embodiment, in the course of the tightening of the clamping screw 56, the guide leg 100 can enter the recess 24 of the neighboring protuberance 20. The recess 24 can, however, also be replaced by a recess in the inner surface 106 of the main body 30 for receiving the guide leg 100.

In both embodiments of the securing element, its main body 30 could also have a vertical channel located in its interior for engagement of a tongue-shaped guide web of the clamping member 58 and 58', respectively, therein, with this guide web replacing the guide webs 60 of the first embodiment and the guide leg 100 of the second embodiment, respectively.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A sink apparatus comprising:

(a) a sink for being built-in into an opening of a cover plate, said sink being made of a plastic composite material and having an upwardly facing topside, an underside, said underside providing circumferential sink surface portions for forming a circumferential space between the sink and a circumferential surface of said plate opening, a downwardly facing supporting surface disposed between said topside and said underside, said supporting surface extending circumferentially around the sink for being placed onto an upwardly facing load carrying surface of the cover plate, and a downwardly recessed sink portion for protruding into said plate opening, (b) a plurality of securing devices for tightening said supporting surface against said load carrying surface, each of said securing devices comprising a main body with a threaded bore extending within said circumferential space transversely to said supporting surface, a clamping screw held in said threaded bore, and a clamping member capable of being tightened against and supported on said cover plate, said clamping member being carried by the clamping screw, said screw having an abutment portion supporting said clamping member for forcing the clamping member towards said supporting surface by turning said screw, wherein at least one slot facing said circumferential space and extending at least approximately parallel to said supporting surface is formed in said circumferential sink surface portions, wherein said main body has a web-like projection extending substantially transversely to said threaded bore for being inserted into said slot, said projection having a maximum overall thickness greater than the width of the slot for achieving a press fit of said projection within said slot, and wherein, said main body forms at least one slide surface cooperating with said clamping member for preventing turning of the clamping member around said clamping screw while allowing displacement of the clamping member towards said supporting surface.

2. The sink apparatus of claim 1, wherein said main body has a supporting surface area for abutting against the circumferential surface of said plate opening.

3. The sink apparatus of claim 2, wherein the supporting surface area of said main body lies substantially opposite said projection.

4. The sink apparatus of claim 1, wherein the length of said projection measured in the longitudinal direction of said slot is at least equal to the width of said clamping member measured in said direction.

5. The sink apparatus of claim 1, wherein said main body and said projection form an integral injection molded plastic part.

6. The sink apparatus of claim 1, wherein said projection has at least one elevation to counteract the pulling of said projection out of said slot.

7. The sink apparatus of claim 6, wherein said projection is provided with at least one lamina forming said elevation, said lamina extending in the longitudinal direction of said slot.

8. The sink apparatus of claim 1, wherein said main body is combinable with (i) a first clamping member being an under-engaging element for engaging under said cover plate and (ii) an alternative clamping member being a spreading element for being supported on the circumferential surface of said plate opening, said main body having an oblique abutting surface for being slidably engaged by said alternative clamping member.

9. The sink apparatus of claim 1, wherein said main body has a block-shaped portion in which said threaded bore is located.

10. The sink apparatus of claim 9, wherein said main body has reenforcement fins extending between said projection and said block-shaped portion.

11. The sink apparatus of claim 1, wherein a plurality of protuberances is provided on said sink below said supporting surface at said circumferential sink surface portions, said protuberances being spaced from one another in a circumferential direction of the sink, each of said protuberances having a slot formed in a surface of the protuberance facing said circumferential space.

12. The sink apparatus of claim 11, wherein said slot is longer than said projection when being measured in said circumferential direction.

13. The sink apparatus of claim 1, wherein said slot extends continuously around the sink.

* * * * *